US006748855B1

(12) United States Patent
Hahne et al.

(10) Patent No.: US 6,748,855 B1
(45) Date of Patent: Jun. 15, 2004

(54) DEVICE AND METHOD FOR BLOCKING A STACK OF STACKED OBJECTS

(75) Inventors: Ernst August Hahne, Allschwil (DE); Franz Knopf, Buhl (DE); Hermann Kunzig, Weil am Rhein (DE)

(73) Assignee: Eltex-Elektrostatik GmbH, Rhein (DE)

( * ) Notice: Subject to any disclaimer, the term of this patent is extended or adjusted under 35 U.S.C. 154(b) by 352 days.

(21) Appl. No.: 09/423,232

(22) PCT Filed: May 13, 1998

(86) PCT No.: PCT/EP98/02838

§ 371 (c)(1),
(2), (4) Date: Nov. 4, 1999

(87) PCT Pub. No.: WO98/51602

PCT Pub. Date: Nov. 19, 1998

(30) Foreign Application Priority Data

May 13, 1997 (DE) ..... 197 19 935

(51) Int. Cl.[7] ..... B65H 31/34

(52) U.S. Cl. ..... 100/70 R; 100/250; 414/788; 414/788.9; 414/907

(58) Field of Search ..... 100/70 R, 35, 100/102, 246, 250, 90, 914; 414/788, 788.1, 788.9, 789.9, 790.6, 907; 271/208

(56) References Cited

U.S. PATENT DOCUMENTS

| | | | | | |
|---|---|---|---|---|---|
| 2,640,605 | A | * | 6/1953 | Chatterton | 126/377.1 |
| 4,657,465 | A | * | 4/1987 | Aoki | 414/907 |
| 4,765,791 | A | * | 8/1988 | Brandt et al. | 414/907 |
| 5,228,373 | A | * | 7/1993 | Welsch | 414/788 |
| 5,437,534 | A | * | 8/1995 | Gales | 414/907 |
| 5,868,546 | A | * | 2/1999 | Hahne et al. | 414/907 |
| 6,015,257 | A | * | 1/2000 | Hahne et al. | 414/788 |
| 6,102,651 | A | * | 8/2000 | Hahne et al. | 414/907 |

* cited by examiner

*Primary Examiner*—John Sipos
*Assistant Examiner*—Louis Huynh
(74) *Attorney, Agent, or Firm*—Antonelli, Terry, Stout & Kraus, LLP

(57) ABSTRACT

The invention is a method and a device for blocking a stack of stacked objects. A device for blocking in accordance with the invention includes two opposed side walls which engage the stack, a pressing device which has at least two pressing elements opposite one another which contact the stack, between which elements of the stack are compressed while contacting the side walls, and charging electrodes which charge the stack, and wherein the charging electrodes are located in at least one of the pressing elements.

22 Claims, 2 Drawing Sheets

DEVICE AND METHOD FOR BLOCKING A STACK OF STACKED OBJECTS

BACKGROUND OF THE INVENTION

1. Field of the Invention

The invention relates to a device as well as a method for blocking a stack of stacked objects, for example stacked newspapers, magazines, or the like.

2. Description of the Prior Art

A device of this kind is known (WO-96/33118) and has a lifting table by which a stack of stacked objects lying thereon can be pressed against two flaps serving as counterpressure plates. During the compression of the stack, the stack is blocked by charging electrodes located laterally with respect to the stack. Since the paper stack has a higher dielectric constant than air, the electrical field concentrates in the X stack. In addition to this concentration, the field is concentrated in the superfluous air inclusions in the stack, so that the field force effect in the stack and in the charge accumulated at the surface compresses the air in the stack. As a result, the adhesion of the objects is decreased, so that the stack is mechanically and firmly blocked and consequently is secured. During the compression of the stack, charging electrodes located laterally next to the stack, depending on the height of the stack, can be switched on.

Similar devices are known for blocking stacks (DE-44 34 946 A1 and DE-44 41 431 A1) that have a transport table, with lateral charging electrodes located on the transport table, said electrodes extending perpendicularly to the transport direction of the stack and extending perpendicularly to the transport table for the entire height of the stack. Opposite the transport table is another grounded charging electrode that contacts the stack from above. This charging electrode can be provided with one or more rollers that are pressed from above against the stack.

Finally, a device is known for aligning, pressing, and blocking packets of loosely stacked printed products (G 295 06 231 U1). This device consists of a packet conveyor with a front packet stop that can be raised and lowered, two packet aligning plates located laterally with respect to the packet conveyor and capable of being brought together or moved apart, and a pressing device above that can be raised and lowered and can be placed between the packet alignment plates on top of the packet to be pressed. It has a charging assembly for electrostatic blocking of the printed products, whose charging electrodes are connected to the packet alignment plates located laterally with respect to the packets and to the pressing device, so that the packets are charged with a voltage on their lateral wall areas and their tops.

SUMMARY OF THE INVENTION

The object of the invention is a device for blocking a stack of stacked objects, stacked newspapers, magazines, or the like for example, by which the stack to be blocked can be charged very effectively.

This object is achieved in a device and a method.

The device according to the invention has a pressing device with two pressing elements opposite one another, between which a stack can be pressed. The charging electrodes for charging this stack are integrated into the pressing elements opposite one another, so that the latter are pressed against the stack when compressing the stack. In addition, charging electrodes can also be provided in the side walls to which a high positive or negative voltage is applied, in any case with a different polarity than on the upper charging electrodes.

The device according to the invention is very simple in design, because the charging electrodes, which are known from the prior art and as a rule are located laterally next to the stack to be blocked, can be completely eliminated, since they are integrated into the pressing elements.

The pressing elements opposite one another thus form, in the manner of a plate capacitor, an electrical field that runs essentially parallel to the pressing direction and passes perpendicularly through the objects to be stacked, for example newspapers, magazines, or the like, so that the desired displacement charges accumulate on their surfaces and build up a capacitive displacement field that opposes the electrical field applied externally. Since the directions of the electrical field applied externally and of the displacement field induced in the stacked objects run parallel to one another, during pressing a capacitive displacement current flows so that the charging of the stack is extremely effective and by which high adhesion forces are produced. The displacement current is produced by the air being forced out of the stack.

Although it is known (WO 96/33118) to ground the supporting table that serves as a pressing element and the flaps located opposite the supporting table or to apply the same potential, so that here as well, charging electrodes are provided above and below the stack for blocking the latter. Since the supporting table and flaps are at the same potential however, and additional charging electrodes are located laterally, a field pattern is produced that passes diagonally through the stacked objects.

Preferably, the stack is charged by the device according to the invention during pressing at the same time, since as a result of the compression of the stack, its dielectric constant is increased during pressing, so that a correspondingly high electrical field forms between the charging electrodes.

BRIEF DESCRIPTION OF THE DRAWINGS

The invention will now be described as an example with reference to the drawing in greater detail.

DESCRIPTION OF THE PREFERRED EMBODIMENTS

Figure 1:
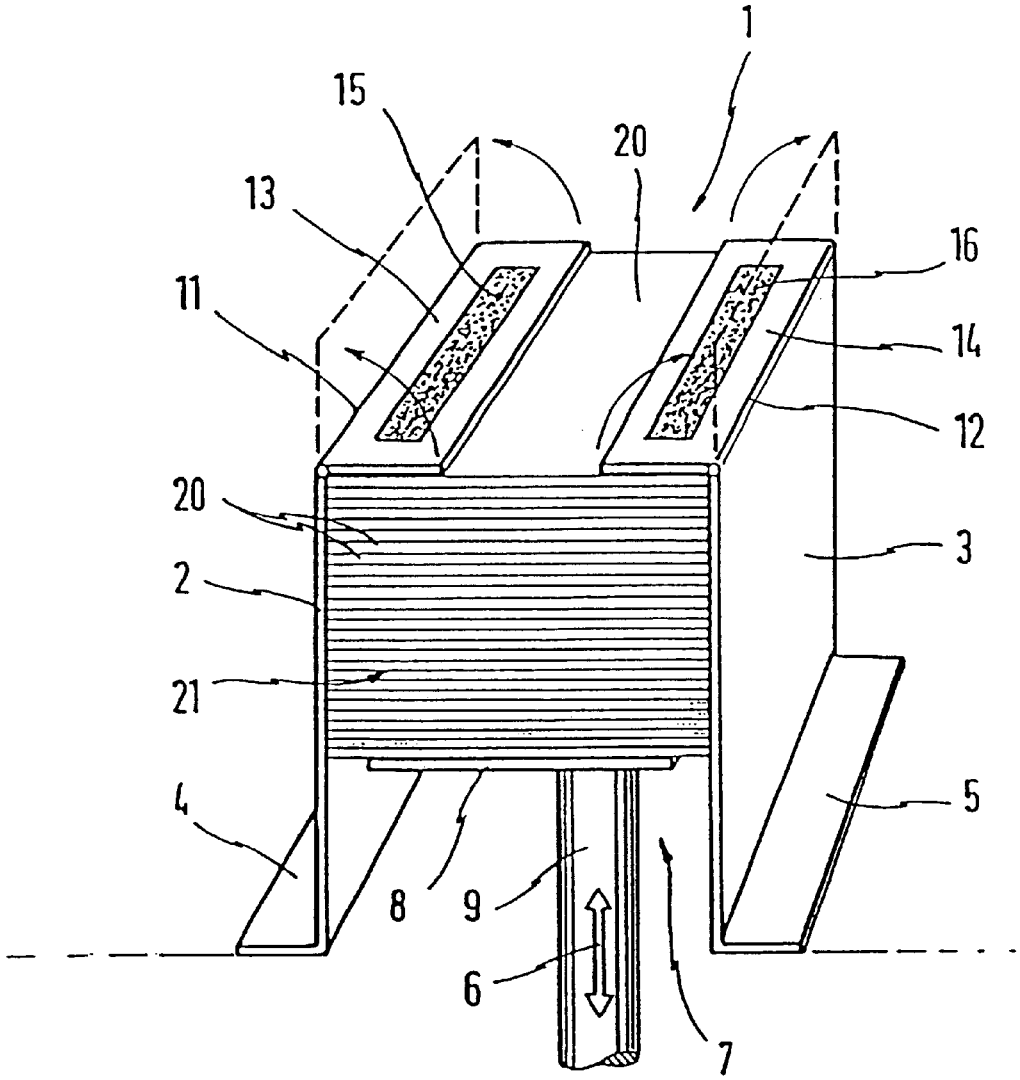
FIG. 1 shows a first embodiment of the device according to the invention, in a schematic perspective view.

The device according to the invention for blocking a stack of stacked objects, for example stacked newspapers, magazines, or the like, is designed as a vertical shaft 1 with two opposite vertical side walls 2, 3. The side walls are fastened by their lower ends using outwardly bent ribs 4, 5 to a working device, especially a stacker.

The bottom of shaft 1 is formed by a lifting table 7 that can be moved vertically up and down (arrow 6), said table consisting of a horizontal lifting plate 8 and a lifting cylinder 9, at whose upper end lifting plate 8 is fastened.

On the vertical side walls 2 and 3, flaps 13, 14 are fastened with articulation to each of the upper horizontal lengthwise edges 7,12 so that flaps 13, 14 can be folded inward around the lengthwise edges 11,12 between a horizontal position in which they project into shaft 1 and a vertical position illustrated in phantom in which they are folded out as straight-line extensions of side walls 2, 3. In the horizontal position, the flaps 13, 14 can be secured by a locking device (not shown) so that they can withstand a considerable pressure from below. In flaps 13 and 14, charging electrodes designed as electrode plates 15, 16 are provided, each of which is electrically insulated from the other flap areas of flaps 13, 14. Preferably, the charging electrode plates 15 and 16 are designed so that when flaps 13, 14 are folded in, they project downward slightly at flaps 13, 14.

The two charging electrode plates 15, 16 are connected to a high-voltage source and both can preferably be connected to the same potential, The lifting plate 8, which is opposite the two flaps 13, 14 in shaft 1, is designed as an electrically conducting metal plate and is preferably connected to ground or connected to a voltage which has a polarity opposite that of the voltage applied to charging electrode plates 15, 16.

Figure 2:
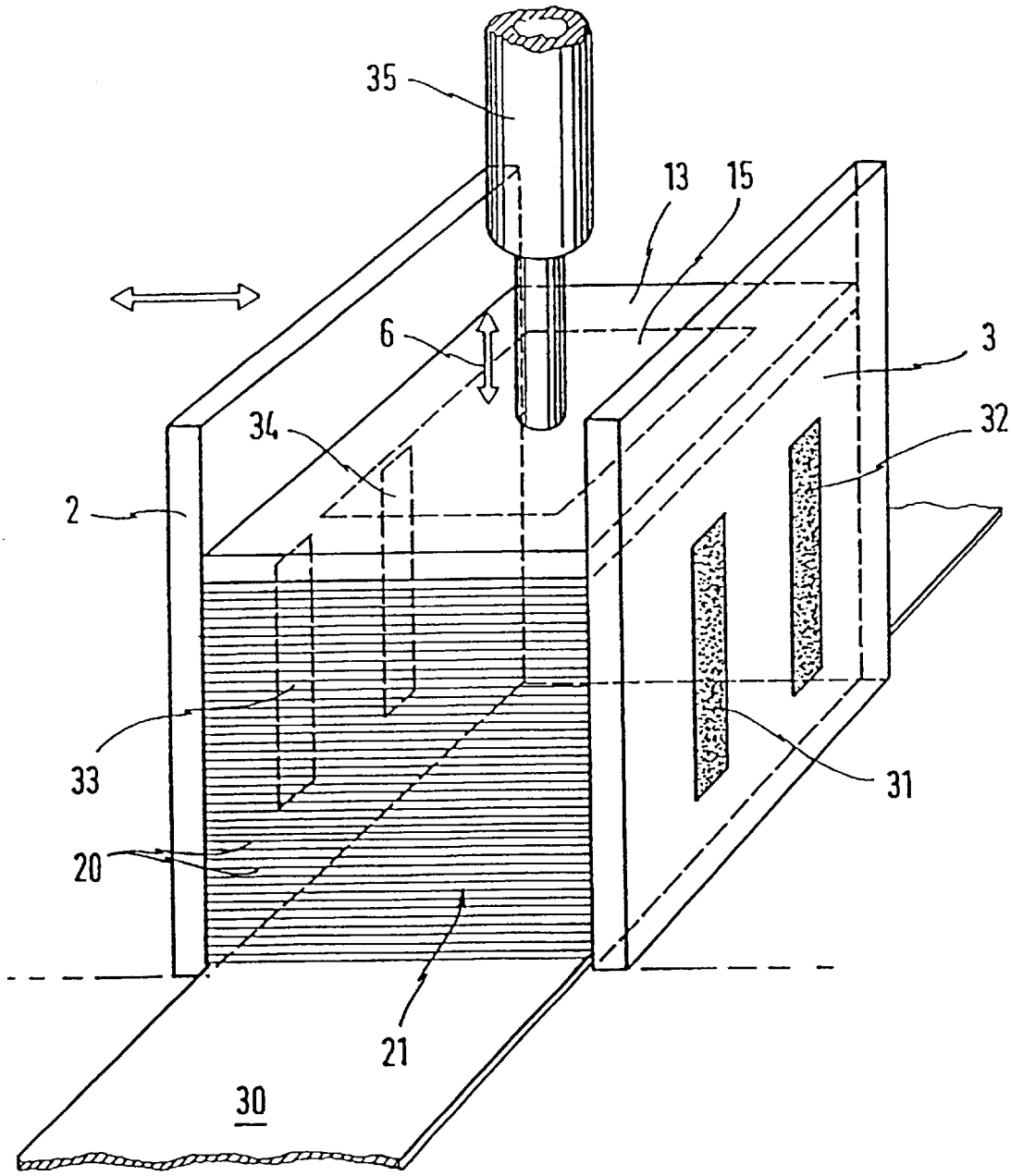
FIG. 2 shows a second embodiment of the device, likewise in a schematic view.

FIG. 2 shows a second embodiment of the invention, with the same reference numerals representing identical parts. The important difference from the embodiment shown in FIG. 1 lies in the use of a conveyor belt 30 which is designed to be grounded and capable of carrying objects away. The stack, represented by 21 as a whole, is introduced on this conveyor belt 30 into the device according to FIG. 2. Then the side walls 2,3 are brought together laterally to align the stack. These side walls are additionally provided with electrodes 31, 32 and 33, 34 inserted into them, said electrodes being electrically insulated from the remaining side walls.

In another deviation from the embodiment according to FIG. 1, the pressing element 13 located at the top can be moved by means of a preferably pneumatic lifting cylinder represented schematically by 35. A charging electrode plate 15, likewise electrically insulated, is inserted into the upper pressing plate 13, said plate 15 also being capable of being connected to a high voltage source. During pressing in the vertical direction as indicated by directional arrow 6, stack 21 is compressed, with a capacitive displacement current being produced by the escape of air from the individual objects 20 forming the stack 21.

The operation of the device according to the invention for blocking the stack will be explained below with reference to FIG. 1.

With flaps 13, 14 opened, the objects to be stacked, for example newspapers, magazines, or the like, are introduced from above into the shaft 1, whereupon they fall on lifting plate 8 and are aligned by the side walls 2, 3 that serve as packet aligning plates. When a predetermined quantity of objects 20 to be stacked has accumulated in shaft 1, flaps 13, 14 are folded into their horizontal positions and secured. The stack 21 located between the lifting plate 8 and the flaps 13, 14 is compressed and squeezed by raising the lifting plate 8 between flaps 13, 14 and the lifting plate 8. At the sate time, a previously determined, preferably negative high voltage is applied to the charging electrode plates 15, 16 so that an electrical field is formed between the charging electrode plates 15, 16 and the lifting plate 8 connected to ground, said field passing through the objects 20, stacked on top of one another in layers, essentially perpendicularly to their wide sides. As a result of the sudden voltage rise dU/dt and a simultaneous compression of the stack 21, a capacitive displacement current dI/dt flows through stack 21, said current being produced by the sudden voltage rise, the simultaneous increase in the dielectric constant, as well as a decrease in the resistance due to the pressure contact between the charging electrode plates 15, 16 that act as charging electrodes, the stack 21, and the lifting plate 8 that acts as a charging electrode.

As a result of the direct contact between the charging electrode plates 15, 16 and the stack 21, in contrast to the known zero-contact transfer of the electrical charge known from the prior art, an improved efficiency is achieved so that the high-voltage generator used with the device according to the invention can be made smaller than the high-voltage generator used in known devices for blocking.

The charging electrodes can be adjusted or adapted to the stacked height of the stack 21 located in shaft 1 and composed of objects 20 to be stacked automatically in the device according to the invention, since the charging electrodes are designed on the pressing elements located opposite one another between which stack 21 to be blocked is pressed.

Since the charging electrode surfaces are in mechanical contact with the objects to be stacked, no contamination can adhere to them as it is known to do on the high-voltage electrodes that operate without contact conventionally and which must be cleaned at regular intervals, often within a few days.

What is claimed is:

1. A device for blocking a stack of stacked objects, comprising:

two opposed side walls which engage sides of the objects of the stack, a pressing device including two end elements opposite one another which contact ends of the stack of stacked objects, one of the end elements pressing toward another of the end elements to compress the stack of stacked objects, while the stack of stacked objects contacts the side walls, and at least one changing electrode which charges the stack of stacked objects, and wherein one of the least one charging electrode is a metal plate which contacts an end of the stack to transfer a charge to the stack and is part of one of the two end elements.

2. A device according to claim 1, wherein:

one of the two end elements comprises a pressure plate and another of the two end elements comprises a pair of flat pivotable flaps.

3. A device according to claim 2 wherein:

additional charging electrodes are located on the two opposed side walls.

4. A device according to claim 2, wherein:

the pressure plate is grounded.

5. A device according to claim 4 wherein:

additional charging electrodes are located on the two opposed side walls.

6. A device according to claim 2, wherein:

the pair of flat pivotable flaps each include a charging electrode comprising a flat metal plate integrated therein with the charging electrodes being electrically insulated from the pressure plate.

7. A device according to claim 6 wherein:

additional charging electrodes are located on the two opposed side walls.

8. A device according to claim 6, wherein:

the pressure plate comprises a lifting plate located on a lifting cylinder movable toward and away from the pair of pivotable flaps.

9. A device according to claim 8 wherein:

additional charging electrodes are located on the two opposed side walls.

10. A device according to claim 7, wherein:

the flaps are located opposite the lifting plate and the stacked objects are compressed by the lifting plate.

11. A device according to claim 10 wherein:

additional charging electrodes are located on the two opposed side walls.

12. A device according to claim 10, wherein:

the flaps are articulated lengthwise along edges of the two opposed side walls, with the two opposed side walls defining a shaft and the flaps defining a top of the shaft with the flaps being pivotable lengthwise between a vertical position in which the flaps are an extension of the two side opposed walls and a horizontal position at which the flaps project horizontally into the shaft against which a top of the stack of stacked objects is compressed.

13. A device according to claim 12 wherein:

additional charging electrodes are located on the two opposed side walls.

14. A device according to claim 12, wherein:

the flaps include a locking device which locks the flaps in the horizontal position to resist pressure on the stack produced by the lifting plate.

15. A device according to claim 14 wherein:

when the flaps are in the horizontal position, the flat metal plates of the charging electrodes contact the end of the stack and transfer charge to the stack.

16. A device according to claim 14 wherein:

additional charging electrodes are located on the two opposed side walls.

17. A device according to claim 12 wherein:

when the flaps are in the horizontal position, the flat metal plates of the charging electrodes contact the end of the stack.

18. A device according to claim 17 wherein:

additional charging electrodes are located on the two opposed side walls.

19. A device according to claim 1 wherein:

the another of the end elements is a grounded conveyor belt.

20. A device according to claim 19, wherein:

additional charging electrodes are located on the two opposed side walls and have a polarity opposite to that of the at least one charging electrode which is the metal plate.

21. A device according to claim 19 wherein:

additional charging electrodes are located on the two opposed side walls.

22. A device according to claim 1 wherein:

additional charging electrodes are located on the two opposed side walls.

* * * * *